US005441210A

United States Patent [19]

Hinton

[11] Patent Number: 5,441,210

[45] Date of Patent: Aug. 15, 1995

[54] APPARATUS AND METHOD FOR CONTROLLING TENSION AND STOPPING ACTION OF WEB MATERIAL

[76] Inventor: Gaylen R. Hinton, 4316 Buckeye La., Merced, Calif. 95348

[21] Appl. No.: 138,476

[22] Filed: Oct. 15, 1993

[51] Int. Cl.[6] ..... B65H 23/08

[52] U.S. Cl. ..... 242/421.1; 242/421.2; 242/563.2

[58] Field of Search ..... 242/421.2, 421.1, 421.3, 242/421.4, 422.2, 422.3, 420.5, 563.2

[56] References Cited

U.S. PATENT DOCUMENTS

| | | | |
|---|---|---|---|
| 1,930,733 | 10/1933 | Tomlin . | |
| 2,011,371 | 8/1935 | Mohler | 242/420.5 X |
| 2,366,148 | 12/1944 | Montgomery | 242/420.5 X |
| 2,963,236 | 12/1960 | Grosser et al. . | |
| 3,100,554 | 8/1963 | Doubek . | |
| 3,232,551 | 2/1966 | Rathmann | 242/421.2 |
| 3,255,979 | 6/1966 | Treff . | |
| 3,257,086 | 6/1966 | Drenning | 242/421.4 X |
| 3,452,944 | 7/1969 | Ingram | 242/563.2 X |
| 3,720,383 | 3/1973 | Crawford . | |
| 3,749,331 | 7/1973 | Nedreski | 242/420.5 X |
| 3,862,723 | 1/1975 | Bonikowski | 242/421.2 X |
| 3,979,080 | 9/1976 | Herbert et al. | 242/563.2 |
| 4,151,594 | 4/1979 | Stern | 242/421.2 X |
| 4,199,118 | 4/1980 | Tetro et al. | 242/421.2 X |
| 4,286,757 | 9/1981 | Wirth | 242/421.2 X |
| 4,691,499 | 9/1987 | Umeda et al. | 242/421.2 X |
| 4,697,408 | 10/1987 | Kobata et al. . | |
| 4,773,610 | 9/1988 | Nordlof . | |
| 4,775,088 | 10/1988 | Seko . | |
| 4,844,371 | 7/1989 | Tahara . | |
| 4,979,691 | 12/1990 | Kobayashi . | |

FOREIGN PATENT DOCUMENTS

| | | | |
|---|---|---|---|
| 0458465A3 | 11/1991 | European Pat. Off. . | |
| 212662 | 9/1988 | Japan | 242/421.2 |
| 2138400 | 3/1984 | United Kingdom . | |
| WO9107341 | 5/1991 | WIPO . | |

*Primary Examiner*—John M. Jillions
*Attorney, Agent, or Firm*—Morgan & Finnegan

[57] ABSTRACT

An apparatus and method for controlling the tension and stopping action of web material fed from a supply roll is disclosed. A supply roll of web material is supported on a support assembly. A brake is operatively connected to the support assembly for applying a braking force onto the support assembly to apply tension onto the withdrawn web material. The diameter of the supply roll is sensed and a signal is generated to the power supply of a brake proportional to the diameter of the supply roll to vary the applied braking force and maintain a constant tension on the web material during its withdrawal. A stopping signal is generated to the brake power supply during stopping operation of film withdrawal to increase the braking force supplied to the support assembly. The stopping signal is an additive combination of a first signal that is essentially proportional to the diameter of the supply roll and a second signal that is essentially constant.

9 Claims, 3 Drawing Sheets

APPARATUS AND METHOD FOR CONTROLLING TENSION AND STOPPING ACTION OF WEB MATERIAL

FIELD OF THE INVENTION

This invention relates to an apparatus and method for controlling the tension and stopping action of web material fed from a web supply roll positioned on a support assembly where a stop signal is generated to a brake during stopping operation of web withdrawal to increase the braking force supplied to the support assembly and prevent overrunning of the supply roll.

BACKGROUND OF THE INVENTION

In high speed bottle labeling, paper manufacturing, and other similar industries where a web of thin material such as polymer film or paper is withdrawn from a rotatably mounted supply roll, a braking force is typically applied onto the assembly supporting the supply roll to ensure that uniform tension is maintained on the withdrawn web material as it is processed. These supply rolls have high inertia which varies as the roll unwinds and its diameter decreases.

The amount of braking force applied onto the support assembly is usually varied depending on the diameter of the roll and its inertia to maintain constant web tension. During acceleration and deceleration of the supply roll, the braking force on the support assembly must change to maintain the desired web tension and prevent either film breakage caused by excess back tension or prevent overrunning of the web feed caused by a lack of proper tension. Deceleration to a rapid stop position is also difficult because the supply roll can overrun when no additional braking force is applied to compensate for such rapid deceleration. As a result, during rapid supply roll slowdowns into a stop position, additional braking force must be applied on to the support assembly to prevent overruns.

Various prior art systems have been devised to accomplish controlled deceleration into a stop position while preventing overruns. In some processing lines, the operator manually adjusts the tension on the applied web material. Manually adjusting the web tension, however, can be inaccurate depending on the reaction time and accuracy of the operator. Other systems automatically apply an additional braking force during deceleration, but often these systems are complex, using line speed measurement devices which combine their output signals with output signals corresponding to measured inertia changes. Corresponding changes in applied tension then are made based on changes in the line speed and the diameter of the supply roll. Also, in some prior art systems, no compensation is made for the rotational inertia of the support assembly holding the supply roll. Depending on the size of the web roll, the rotational inertia of the support assembly can have a major impact on the amount of braking force that should be applied during stopping operations.

In many web processing lines, the production requirements vary depending on the desired end product. A first production run at the start of a shift may require wide, heavy, large diameter rolls of web material. In this instance, the inertia is primarily in the supply roll itself, and not in the assembly supporting the roll. A stop signal would not have to compensate extensively for the inertia of the support assembly. Other production runs later in the shift, however, may require narrow width, small diameter, lightweight supply rolls, where the inertia of the support assembly has a greater impact on the stopping operation. Thus, the stop signal would have to compensate for the inertia and greater impact of the support assembly.

Therefore, it would be desirable if a more efficient and less complex system were used that generated a stopping signal to a braking mechanism of a supply roll support assembly which not only compensated for the varying supply roll diameter, but also compensated for the rotational inertia of the support assembly.

SUMMARY OF THE INVENTION

It is therefore an object of the present invention to control the tension and stopping action of web material fed from a supply roll where a stop signal can be generated to a support assembly braking mechanism during stopping operation which not only compensates for the varying diameter of a support roll but also compensates for the rotational inertia of the assembly supporting the supply roll.

It is still another object of the present invention to control the tension and stop action of a web material fed from the supply roll where a stop signal can be generated to a braking mechanism during stopping operation of film withdrawal by means of a relatively simple electronic circuit without complex mechanical and electronic components.

The apparatus of the present invention controls the tension and stopping action of film material fed from a supply roll with an efficient and simple electronic system that generates a stop signal to a braking mechanism of a supply roll support assembly which not only compensates for the varying supply roll diameter as the supply roll unwinds, but also compensates for the rotational inertia of the support assembly.

The apparatus includes a supply roll support assembly that supports a supply roll of web material to be withdrawn therefrom. A braking mechanism is operatively connected to the support mechanism for applying a braking force onto the support mechanism and applying tension onto the withdrawn film material. The diameter of the supply roll is sensed and supply roll and tension potentiometers generate an output signal to the braking mechanism that is proportional to the diameter of the supply roll for varying the applied braking force and maintaining constant tension on the withdrawn web material. A stop signal is generated to the braking mechanism during stopping operation of film withdrawal to increase the braking force supplied to the support mechanism. The stop signal comprises the additive combination of a first signal that is essentially proportional to the diameter of the supply roll and a second signal that is essentially constant.

In a preferred embodiment, the supply roll support assembly is rotatably mounted on a frame. The roll diameter sensing mechanism includes a lever pivotally mounted at one end of the frame. The opposing end of the lever engages the outer periphery of the supply roll mounted on the supply roll support assembly. A supply roll potentiometer is operatively connected to the supported end of the lever so that as the lever pivots, the generated voltage signal from the potentiometer changes corresponding to the varying diameter of the supply roll.

A tension potentiometer modifies the signal generated from the supply roll potentiometer to provide a voltage signal to a comparator indicative of a desired tension setting. A resistor is operatively connected to the braking mechanism and the comparator to provide a circuit voltage to the comparator indicative of the current supplied to the braking means. The signal is therefore proportional to the exerted braking force.

A pulse generating mechanism is operatively connected to the comparator for generating a voltage pulse during a stop condition that increases the voltage signal supplied from the supply roll and tension potentiometers to the comparator. A stopping speed potentiometer is operatively connected to the braking mechanism resistor for reducing the value of the circuit voltage to the comparator. A transistor is operatively connected to the stopping speed potentiometer and the pulse generating mechanism for activating the stopping speed potentiometer upon receiving a pulse from the pulse generating mechanism.

BRIEF DESCRIPTION OF DRAWINGS

The foregoing and other objects and advantages of the present invention will be appreciated more fully from the following description, with references to the accompanying drawings in which.

DETAILED DESCRIPTION OF THE PREFERRED EMBODIMENT

The present invention controls the tension and stopping action of a web material such as plastic film label material or other similar web material fed from a supply roll into a web processing system such as a bottle labeling system while compensating for the varying supply roll diameter as it unwinds and while compensating for the rotational inertia of the support assembly.

Figure 1:
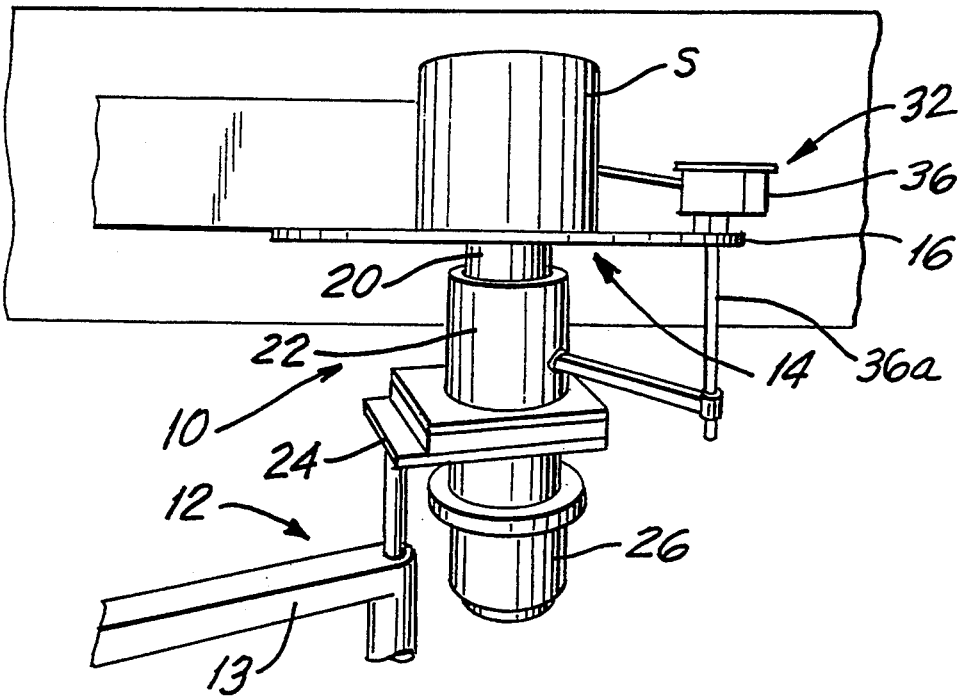
FIG. 1 is a schematic perspective view of the frame, the supply roll support assembly, and the sensing mechanism.

Referring now to the drawings, and more particularly to FIG. 1, the apparatus for controlling the tension and stopping action of web material fed from a supply roll is illustrated generally at 10. The apparatus includes a frame assembly indicated generally at 12 formed of individual support trusses and ground engaging members 13. A supply roll support assembly, indicated generally at 14, is secured to the frame assembly 12 for supporting a supply roll "S" of web material. In the described embodiment, the supply roll "S" is a convoluted roll of thin film plastic polymer label material which is continually cut into labels in wrap-around labeling of containers. The apparatus and method of the present invention however, can also be used for controlling the tension and stopping action of different web materials, such as paper, plastic and other similar thin web materials that are typically supplied from a convoluted roll of web material.

In the illustrated embodiment, the support assembly 14 includes a circular supply roll support plate 16. The support plate 16 is rotatably mounted on the frame 12 by a support shaft 20 and shaft housing 22 rotatably containing the shaft 20, and a housing frame plate member 24 connected to the frame assembly 12 and supporting the shaft housing 22. The support shaft 20 is vertically oriented in the shaft housing 22, and the support plate 16 is secured in a horizontal orientation to the top portion of the support shaft 20. The support plate 16 includes a central cone 17 on which the supply roll "S" is mounted. The web brake 26 is preferably a magnetic particle brake or other similar type of brake, which is consistent over time as well as consistent in producing a relatively linear torque versus applied signal. A power supply (shown as block 30 in the schematic of FIG. 4) provides the power to the brake as is conventional, by energizing a brake coil 31 to provide the braking force. The brake coil 31 typically is an integral part of the web brake 26.

Figure 2:
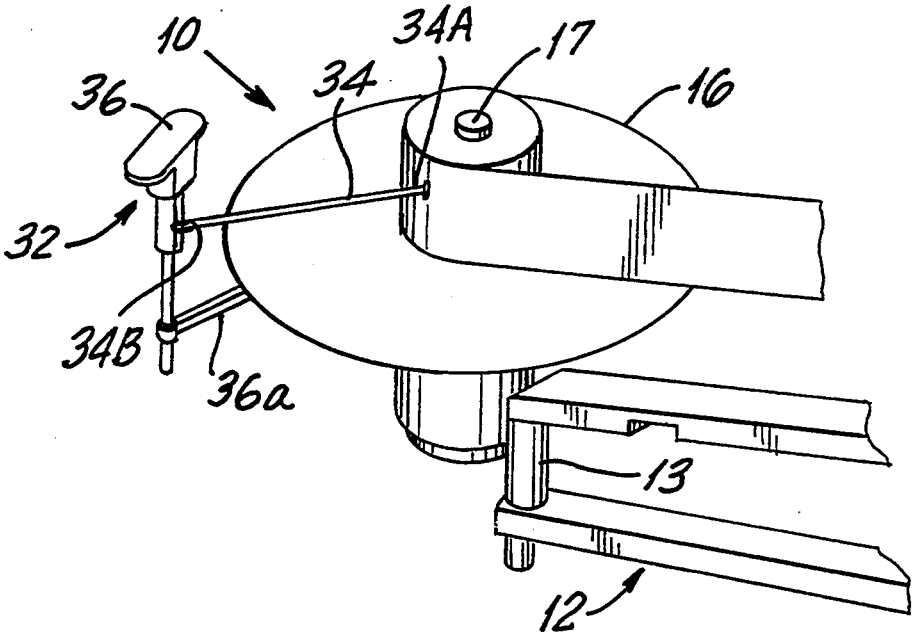
FIG. 2 is a schematic perspective view looking generally downward onto the support assembly and showing in greater detail the pivotally mounted lever arm.
Figure 3:
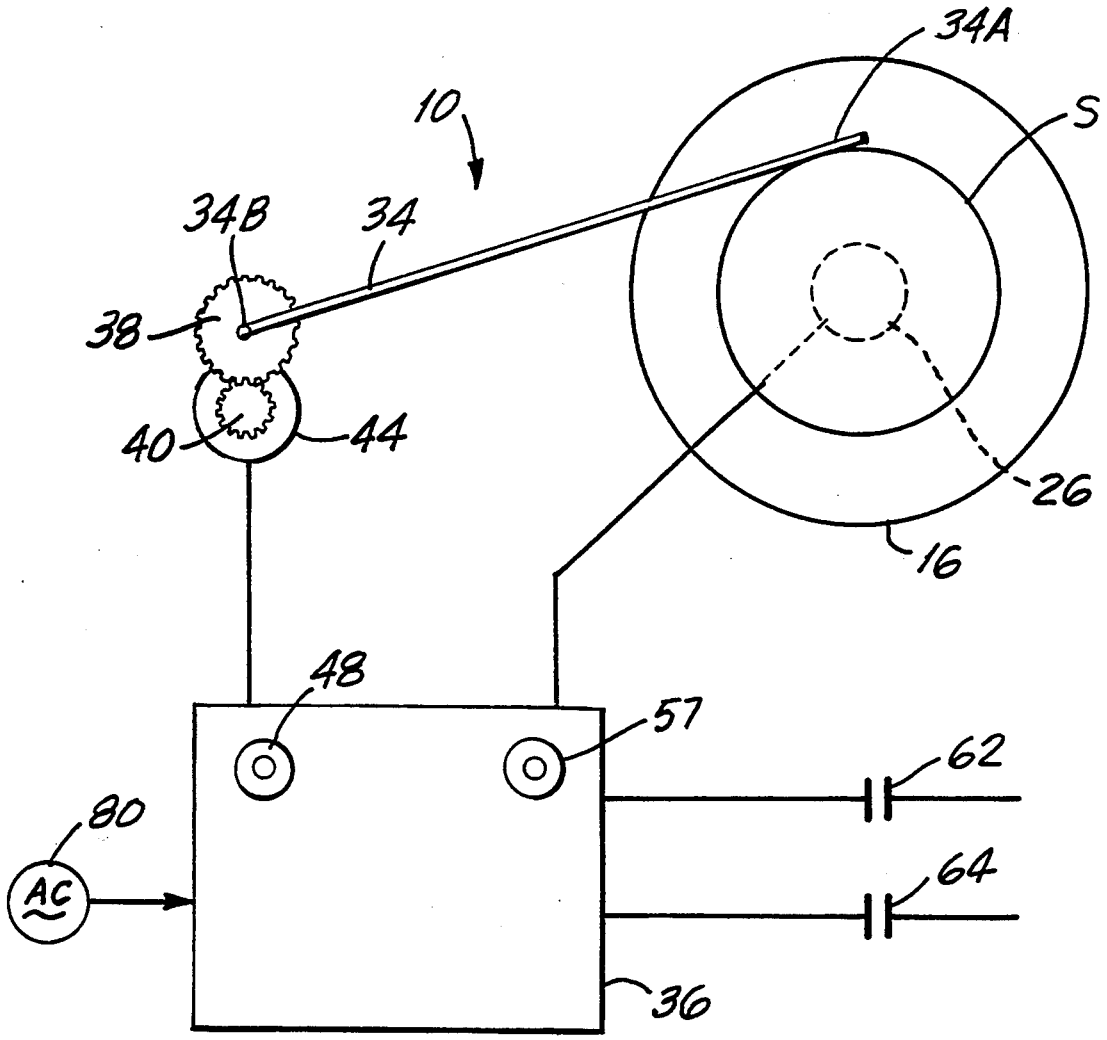
FIG. 3 is a diagram of the mechanical connections between the lever arm and supply roll potentiometer, as well as other components.

The amount of current generated to the power supply 30 is proportional to the web roll diameter as determined by a web diameter sensing mechanism indicated generally at 32. As shown in FIGS. 1, 2 and 3, the sensing mechanism 32 includes a lever arm 34 that is pivotally mounted on a sensor housing 36 fixed to the frame 12. The lever arm 34 has one end **34*a* that engages the outer periphery of the supply roll by spring tension (FIG. 3). The other end 34*b* is fixed to a first circular spur gear 38 that intermeshes with a second spur gear 40 fixed to a supply roll potentiometer 44. As the web diameter changes, the lever arm 34 pivots, thus rotating the first spur gear 38 intermeshing with the second spur gear 40, changing the value of the signal generated from the supply roll potentiometer 44. A second tension potentiometer 46 is operatively connected to the first supply roll potentiometer 44 (FIG. 4) and is supported in a sensor housing 36**.

The tension potentiometer 46 can be manually adjusted to allow an initial setting of what the tension should be as the film unwinds. The operator manually adjusts the tension potentiometer 46 through a tension adjustment screw 48 contained in the sensor housing 36 (FIG. 3). The signal from the supply roll potentiometer 44 is then modified for the desired tension by the tension adjust potentiometer 46 and fed into a comparator 50 which compares the signal to a circuit voltage applied across a current-sensing resistor 52. If the current through the brake and power supply is less than that called for by the sensing mechanism 32, the comparator 50 increases the current to the power supply 30 to the desired level. If less current is necessary, the comparator 50 switches off the supply, allowing the current level to decay to the required level. As will be described later, a stopping transistor 54 and stopping speed potentiometer 56 is contained within the feedback circuit to the comparator 50, but is normally off so that there is no effect from the stopping speed potentiometer 56 on the voltage from the current sensing resistor that feeds the comparator. In the illustrated embodiment, a lead wire circuit **36*a* extends from the sensor housing 36 to the brake housing 22**.

Figure 4:
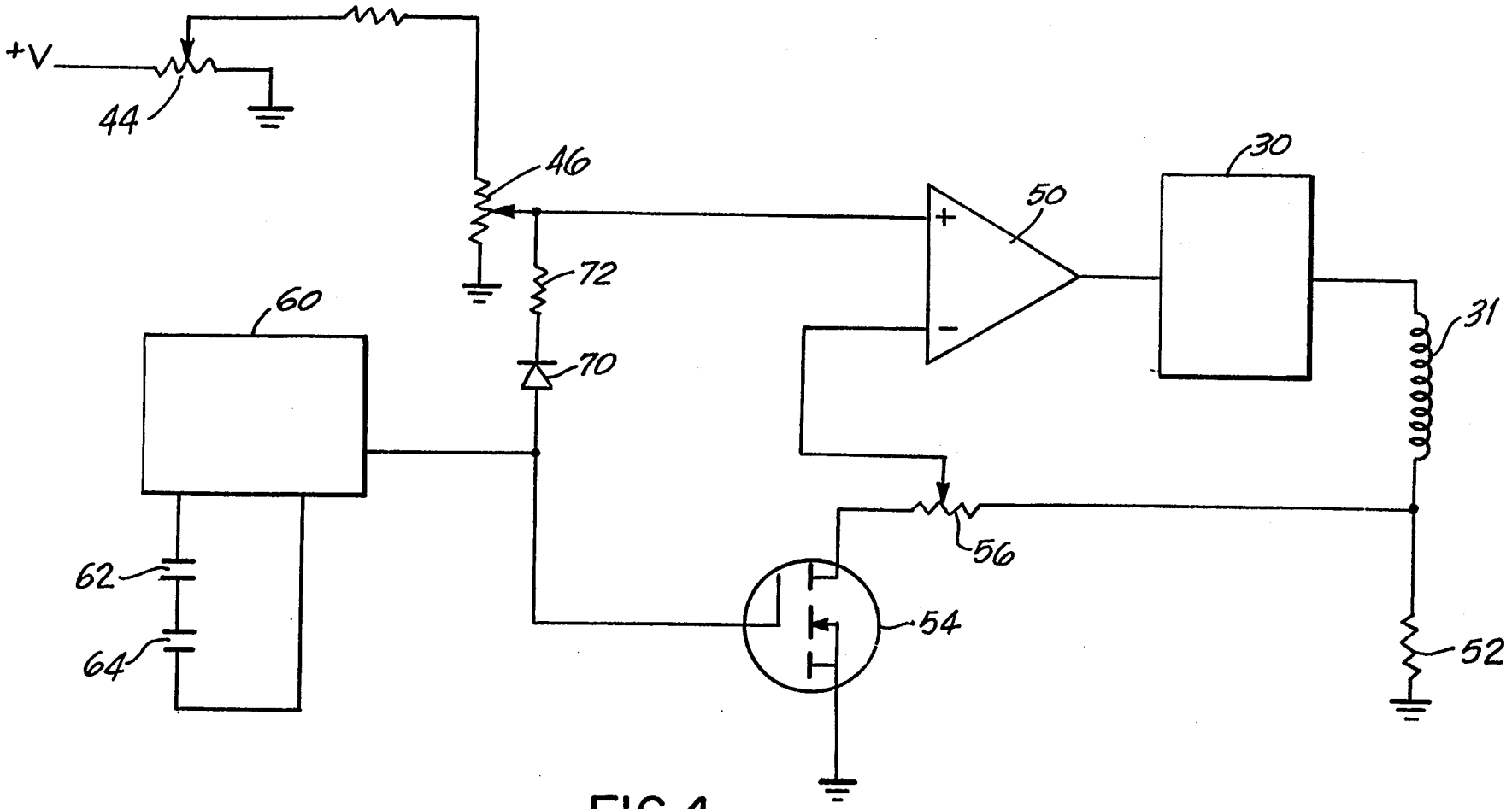
FIG. 4 is an electronic schematic diagram of the web control system of the present invention.

As shown in FIG. 4, a pulse generator (indicated by block 60) is activated whenever the machine run circuit 62 or the web feed circuit 64 is turned off. The generated pulse is typically about 2 seconds duration. The pulse increases the voltage to the comparator by directing a portion of the signal through a diode 70 and resistor 72 and adding the value of the pulse to whatever the voltage is that comes from the supply roll and tension potentiometers 44, 46. Additionally, the pulse is generated to the base of the stopping speed transistor 54, activating the transistor and effectively connecting the side of the stopping speed transistor 54 to ground. This effect reduces the value of the signal reaching the comparator 50 from the current sensing resistor 52 by the same ratio as the position of the stopping speed potentiometer 56. For example, if the stopping speed potentiometer 56 is set at 50%, the signal would be reduced to 50% of the original. If the stopping speed potentiometer 56 is set at 25%, the signal would be 25%. As shown in FIG. 3, the stopping speed can be adjusted by a screw adjust 57, which is shown mounted on the housing 36. The components as described can be mounted on a 6201 control board, manufactured by CMS Gilbreth Packaging Systems. A source of AC power 80 supplies power.

Both functions of the pulse increase the current to the brake coil 31, which in turn increases its stopping power to quickly arrest the motion of the web and prevent overrunning. Activating the stopping speed transistor 54 increases the brake tension inversely proportional to the set ratio of the stopping speed potentiometer 56. If the potentiometer 56 were set at 50%, the brake tension would double for any web ,diameter. If the only concern were the inertia of the web roll, this function of the stopping speed transistor 54 would only be necessary to stop accurately any diameter web. However, different web rolls used in processing do not rotate at the same speed and there is always the rotational inertia of the web roll support assembly which must also be stopped. With a small diameter, narrow web roll, the inertia of the support assembly can be many times greater than the inertia of the roll itself. As a result, the second function of the pulse becomes important.

The pulse is added directly to the comparator 50, increasing the brake tension by a fixed amount regardless of web roll diameter. When a large diameter supply roll is stopped, most of the inertia is contained in the supply roll. This added tension would be a modest increase from normal tension. With a small diameter web supply roll, however, this amount of tension added by the pulse directly to the comparator 50 can be several times the normal tension. This additional tension, therefore, tends to compensate for the inertia of the supply roll support assembly 14. In addition to the larger percentage of inertia contained in the support assembly 14 with the given web feed rate, a smaller roll will also be turning at a faster velocity. Thus, a greater amount of energy is stored in the rotating system because energy is proportional to the square of the rotational velocity.

The added pulse compensates for this increased energy because it not only directly increases the voltage to the comparator 50, therefore increasing the current to the brake power supply 30, but the pulse also multiplies the effect of the stopping speed potentiometer 56. Therefore, by placing an appropriate setting on the stopping speed potentiometer 56, a braking increase can be created that effectively cancels the increased energy generated with a faster rotating, smaller diameter supply roll.

The generated pulse is typically about 2 seconds long. This two-second period typically is long enough for the web-feeding system to decelerate from a high speed into a stopped position. After the system is stopped, the increased brake tension is no longer necessary, and normal tension is resumed. The above invention provides for normal tension as soon as the pulse stops, allowing the web to be rethreaded, repositioned, or adjusted as necessary.

It should be understood that the foregoing description of the invention is intended merely to be illustrative thereof and that other embodiments, modifications and equivalents may be apparent to those skilled in the art without departing from its spirit.

That which is claimed is:

1. An apparatus for controlling the tension and stopping action of web material fed from a supply roll comprising:

means for supporting a supply roll of web material to be withdrawn therefrom, braking means operatively connected to said support means for applying a braking force onto said support means and applying tension onto the withdrawn web material, means for sensing the diameter of the supply roll and generating an output signal to said braking means that is proportional to the diameter of the supply roll for varying the applied braking force and maintaining constant tension on the withdrawn web material, means for generating a stop signal to said braking means during stopping operation of web withdrawal to increase the braking force applied to said support means, said stop signal comprising the additive combination of a first signal that is essentially proportional to the diameter of the supply roll and a second signal that is essentially constant, said apparatus further including a comparator operatively connected to said braking means for comparing the current feeding the braking means with a predetermined standard indicative of the desired amount of web tension for the given roll diameter, wherein said comparator adjusts the amount of braking force to provide the desired amount of web tension, a roll diameter sensing means including a supply roll potentiometer operatively connected to said comparator for generating a voltage signal to said comparator proportional to the supply roll diameter, and a tension potentiometer for modifying the voltage signal generated from the supply roll diameter potentiometer to provide a voltage signal to the comparator indicative of a desired tension setting, a resistor operatively connected to said braking means and comparator to provide a circuit voltage to said comparator indicative of the current supplied to the braking means, said signal therefore being proportional to the amount of braking force exerted by said braking means, and a pulse generating means operatively connected to said comparator for generating a voltage pulse during a stop condition that effectively increases the voltage signal supplied from said supply roll and tension potentiometer to said comparator.

2. The apparatus according to claim 1 including a stopping speed potentiometer means operatively connected to said braking means resistor for reducing the value of said voltage signal generated to said comparator, and including transistor means operatively connected to said stopping speed potentiometer and said pulse generating means for activating said stopping speed potentiometer upon receipt of a pulse from said pulse generating means.

3. An apparatus for controlling the tension and stopping action of web material fed from a supply roll comprising:

a frame;

a supply roll support assembly rotatably mounted on said frame for supporting a supply roll of web material to be withdrawn therefrom, braking means operatively connected to said support assembly for applying a braking force onto the supply assembly and applying tension onto withdrawn web material, a lever and pivotally mounted at one end of said frame, the opposing end of said lever arm engaging the outer periphery of a supply roll mounted on the supply roll support assembly, means operatively connected to said pivotally mounted end of said lever arm for generating an output signal to said braking means corresponding to pivotal movement of said lever arm and proportional to the diameter of the supply roll for varying the amount of braking force applied by said braking means and maintaining a constant tension on the web material as it is withdrawn from the supply roll, means for generating a stop signal to said braking means during stopping operation of web withdrawal for increasing the braking force applied to said support assembly, said stop signal comprising the additive combination of a first signal that is essentially proportional to the diameter of the supply roll and a second signal that is essentially constant and including a comparator operatively connected to said braking means for comparing the current feeding the braking means with a predetermined standard indicative of the desired amount of tension for the given roll diameter, wherein said comparator adjusts the amount of braking force to maintain a desired tension on withdrawn web material, a generating means operatively connected to said lever arm and comprising a supply roll potentiometer operatively connected to said comparator for generating a signal proportional to the supply roll diameter and a tension potentiometer operatively connected to said comparator and said supply roll potentiometer for modifying the signal generated from the supply roll potentiometer to provide a signal to the comparator indicative of a desired tension setting, a resistor operatively connected to said braking means and said comparator to provide a circuit voltage to said comparator indicative of the amount of current, and therefore braking force exerted by said braking means, and pulse generating means operatively connected to said comparator for generating a voltage pulse during a stop condition that effectively increases the voltage signal supplied from said supply roll and tension potentiometers to said comparator.

4. The apparatus according to claim 3 wherein said supply roll support assembly includes a horizontally disposed support surface on which a supply roll of web material is positioned.

5. The apparatus according to claim 3 wherein said braking means comprises a magnetic particle brake.

6. The apparatus according to claim 3 wherein said signal generating means operatively connected to said lever comprises potentiometer means for changing the signal value corresponding to the supply roll diameter as the lever arm pivots.

7. The apparatus according to claim 3 including a stopping speed potentiometer operatively connected to said braking means resistor for reducing the value of said voltage signal generated to said comparator, and including transistor means operatively connected to said stopping speed potentiometer and said pulse generating means for activating said stopping speed potentiometer upon receipt of a pulse from said pulse generating means.

8. A method for controlling the tension and stopping action of web material fed from a supply roll comprising the steps of withdrawing film from a supply roll rotatably mounted on a support assembly which includes a brake operatively connected thereto for applying a braking force on the support assembly for applying tension onto the withdrawn film, sensing the diameter of the supply roll and generating an output signal to the brake for varying the applied braking force on the support assembly for maintaining constant tension on the web material during its withdrawal, generating a stop signal to the brake during stopping operation of web withdrawal for increasing the braking force applied to the support assembly wherein the stop signal comprises the additive combination of a first signal that is essentially proportional to the diameter of the supply roll and a second signal that is essentially constant and further including the steps of comparing the current fed to the brake with a predetermined standard indicative of the desired mount of tension for the given roll diameter and adjusting the amount of braking force to provide the desired amount of tension, generating a signal from a supply roll potentiometer that is proportional to the supply roll diameter and modifying that signal by a tension potentiometer to provide a final signal in the comparing step indicative of a desired tension setting, and generating a voltage pulse during a stop condition that increases the signal supplied from the supply roll and tension potentiometer.

9. The method according to claim 8 including the step of reducing the value of the signal from the braking means by activating a stopping speed potentiometer through a transistor which receives the generated voltage pulse.

* * * * *

UNITED STATES PATENT AND TRADEMARK OFFICE

CERTIFICATE OF CORRECTION

PATENT NO. : 5,441,210

DATED : August 15, 1995

INVENTOR(S) : Gaylen R. Hinton

It is certified that error appears in the above-indentified patent and that said Letters Patent is hereby corrected as shown below:

At Column 1, line 38, change "on to" to --onto--.

At Column 5, line 21, change ",diameter." to --diameter.--.

At Column 7, line 41, change "diameter" to --diameter,--.

Signed and Sealed this

Thirty-first Day of October 1995

*Attest:*

Bruce Lehman

BRUCE LEHMAN

*Attesting Officer*

*Commissioner of Patents and Trademarks*